10/14/88 OR 4,546,506

United States Patent [19]

Houle et al.

[11] Patent Number: 4,546,506

[45] Date of Patent: Oct. 15, 1985

[54] HOME BATHING UNIT

[75] Inventors: Raymond T. Houle, Traverse City; Frederick A. Kilbourn, Suttons Bay; James E. De Kraker, Traverse City; Robert T. Nilsson, Cedar, all of Mich.

[73] Assignee: Silchor, Traverse City, Mich.

[21] Appl. No.: 653,558

[22] Filed: Sep. 24, 1984

[51] Int. Cl.[4] ..... A47K 3/02

[52] U.S. Cl. ..... 4/555; 4/557; 4/559

[58] Field of Search ..... 4/555, 661, 557, 556, 4/558, 552, 596, 601, 604, 605, 538, 584, 590, 569, 549, 543, 607, 664; 128/66

[56] References Cited

U.S. PATENT DOCUMENTS

| | | | |
|---|---|---|---|
| D. 97,729 | 12/1935 | Davock . | |
| D. 143,204 | 12/1945 | Fleischhauer | D4/4 |
| D. 229,180 | 11/1973 | Mollerstedt | D23/55 |
| D. 237,616 | 11/1975 | Gordon | D23/55 |
| D. 237,709 | 11/1975 | Jacuzzi et al. | D23/55 |
| D. 254,206 | 2/1980 | Ogden | D24/38 |
| D. 255,932 | 7/1980 | D'Innocente et al. | D24/36 |
| D. 257,058 | 9/1980 | Laver | D23/55 |
| 2,079,770 | 5/1937 | Robinson | 4/584 |
| 2,081,728 | 5/1937 | Bassett | 4/590 |
| 2,166,469 | 3/1939 | Houston | 4/569 |
| 2,566,495 | 9/1951 | Miyakawa | 4/590 |
| 2,570,053 | 10/1951 | Fowler et al. | 4/556 |
| 2,804,629 | 9/1957 | Ring | 4/556 |
| 2,936,463 | 5/1960 | Tracy | 4/607 |
| 2,977,604 | 4/1961 | Miller | 4/556 |
| 3,113,323 | 12/1963 | Beardsley | 4/549 |
| 3,366,978 | 2/1968 | Jones | 4/555 |
| 3,371,354 | 3/1968 | Hayslet | 4/555 |
| 3,380,078 | 4/1968 | Hanson | 4/555 |
| 3,416,166 | 12/1968 | Hanson | 4/555 |
| 3,423,769 | 1/1969 | Cowley | 4/556 |
| 3,467,969 | 9/1969 | Szekely | 4/543 |
| 3,596,579 | 2/1970 | Petersen | 4/590 |
| 3,662,409 | 5/1972 | Johansson | 4/560 |
| 3,663,971 | 5/1972 | Bonhote | 4/556 |
| 3,703,733 | 11/1972 | McLoughlin | 4/556 |
| 3,719,960 | 3/1973 | Russell | 4/556 |
| 3,736,924 | 6/1973 | Jacuzzi et al. | 128/66 |
| 3,863,275 | 2/1975 | Brendgord et al. | 4/556 |
| 3,864,762 | 2/1975 | Finch et al. | 4/555 |
| 3,964,472 | 6/1976 | Nicollet | 128/66 |
| 4,099,272 | 7/1978 | Sowder | 4/555 |
| 4,112,524 | 9/1978 | Johansson | 4/664 |
| 4,346,485 | 8/1982 | Reed et al. | 4/555 |
| 4,360,935 | 8/1982 | Barrett, Sr. | 4/555 |
| 4,365,367 | 12/1982 | Houle et al. | 4/555 |
| 4,399,569 | 8/1983 | Houle | 4/555 |
| 4,439,877 | 4/1984 | Houle | 4/596 |
| 4,446,586 | 5/1984 | Reed et al. | 4/555 |

FOREIGN PATENT DOCUMENTS

| | | | |
|---|---|---|---|
| 1913248 | 10/1970 | Fed. Rep. of Germany . | |
| 695403 | 12/1930 | France . | |
| 2434617 | 3/1980 | France . | |
| 1213358 | 11/1970 | United Kingdom | 4/555 |
| 1226206 | 3/1971 | United Kingdom | 4/555 |
| 1554165 | 10/1979 | United Kingdom | 4/555 |

*Primary Examiner*—Henry K. Artis

*Attorney, Agent, or Firm*—Price, Heneveld, Huizenga and Cooper

[57] ABSTRACT

A bathing unit is particularly designed for home use, and includes a bathtub with an access opening in one side for easy ingress and egress, and a vertically sliding door to close the access opening. The bathing unit has a unique, combination door guide and grab bar arrangement, an adjustable control console, and a power door lock, all of which permit the bather to readily operate the door by himself, and to adjust the water temperature, flow and whirlpool from a seated position within the bathtub. The bather can receive total bathing and whirlpool therapy in private, without the need for an assistant. The combination door guide and grab bar arrangement includes a pair of support rods located on either side of the access opening, which function both as a track on which the door smoothly and easily glides, and also as vertical grab bars, which greatly facilitate entering and exiting the bathtub, and do not interfer with the operation of the door. The adjustable control console allows a seated bather to move the bathing controls to a convenient location within easy reach. The power door lock securely closes the door to a fully closed and sealed position without significant manual effort, and includes a remote actuator located on the control console to further facilitate the use of the bathing unit without an attendant, or other assistance.

67 Claims, 18 Drawing Figures

HOME BATHING UNIT

CROSS-REFERENCE TO RELATED PATENTS

The present application is related to our issued U.S. Pat. Nos. 4,346,485; 4,446,586; 4,365,367; 4,399,569; and 4,439,877 on an APPARATUS AND METHOD FOR BATHING INVALIDS, which are hereby incorporated by reference.

BACKGROUND OF THE INVENTION

The present invention relates to bathing devices, and in particular to a bathing unit specifically designed for home use.

Bathing units for invalids confined to hospitals, nursing homes, convalescent and retirement centers, and other similar institutions are presently available, and generally comprise a bathtub with some type of lifting device to transfer the patient from a wheelchair or gurney into the bathtub.

A novel apparatus and method for bathing invalids is disclosed in our prior U.S. Pat. Nos. 4,346,485; 4,446,586; 4,365,367; 4,399,569; and 4,439,877. This apparatus includes a lateral access opening in one side of the bathtub to facilitate transferring the invalid into and out of the bathtub, and a vertically sliding door to selectively close the access opening. The bathing unit is particularly adapted for bathing invalids, and others with impaired ambulatory ability, and requires the aid of an assistant or attendant. The door lock is a manually operated, mechanical device that is operated from outside of the bathtub by an assistant. Also, the control panel for the water controller is located at the foot end of the bathtub, away from the seat area, so that the controls are designed to be manipulated only by an assistant. The bathing unit has a special toe space, and a notch in the door which make it easier for the assistant to reach into the bathtub to bathe the invalid. Furthermore, the bathtub seat is at the level of a conventional wheelchair, and one side of the seat is fully open, so that the assistant can shift the patient between the bathtub and a wheelchair with a natural, unstrained swinging motion, which permits the attendant to keep his feet fixed on the floor, and maintain the weight of the invalid close to his body to minimize muscle strain. The bathtub door can be raised to a fully overhead position, so that it is not in the way when the assistant transfers the patient between the bathtub and the wheelchair. All of these features assist the attendant in providing complete and thorough bathing of the invalid, while minimizing strain and effort on his part.

The present bathing unit is particularly designed for home use, and does not require the help of an attendant, or other assistant. The bather can operate the bathing unit by himself from a seated position within the bathtub. The unit provides heated, whirlpool bathing, which is becoming increasingly popular among people of all ages. The unit can also provide hydrotherapy, which is particularly useful for minor muscle aches, and other self-health care, as well as for the elderly. Since the services of an attendant are not required to bathe in the present unit, the bather can maintain privacy, if the bather so desires.

SUMMARY OF THE INVENTION

One aspect of the present invention is a home bathing unit, comprising a bathtub having opposite sidewalls and end walls, with an access opening in one of the sidewalls for ingress and egress therethrough. A seat is located in the bathtub adjacent to one of the end walls, and a door selectively closes the access opening. A mechanism is provided for vertically guiding the door between a fully open position wherein bather movement through the access opening is permitted, and a fully closed position wherein the door sealingly closes the access opening. The door has a lock mechanism to securely lock the door in the fully closed position. A lock actuator is operably connected with the lock, and is positioned to be manipulated by a bather disposed on the seat of the bathtub. A handle is located on the door at a position from which a bather disposed on the seat of the bathtub can grasp the handle to manually translate the door between the fully open and fully closed positions. A door controller is provided, having a mechanism for retaining the door in the fully open position until moved therefrom by the bather. A device is also provided for adjusting the height of the door in the fully open position, so that the door is high enough to permit the bather to readily enter the bathing unit through the access opening without any interference, yet low enough to permit the bather, when disposed on the seat of the bathtub, to reach the handle on the door to manipulate the same. In this manner, the bather may enter and exit the bathing unit, and open, close, and lock the door by himself from a seated position within the bathtub, without requiring an assistant.

A spring loaded counterbalance may be connected with the door to resiliently retain the same in the fully open position. The counterbalance includes a device for adjusting spring tension, and an adjustable stop may be provided to positively locate the door in the selected fully open position.

Another aspect of the present invention is a combination door guide and grab bar arrangement for bathing units of the type having a bathtub with an access opening in one side, and a vertically translating door to selectively close the opening. The combination door guide and grab bar arrangement comprises a pair of upright support posts positioned adjacent opposite side edges of the door, which are oriented in a mutually parallel and generally vertical relationship. Guides are mounted on the opposite side edges of the door, and are telescopingly received over the support posts for sliding translation therealong. The support posts both guide the door between the open and closed positions, and provide vertical grab bars along the sides of the access opening to facilitate ingress and egress, without interfering with the operation of the door.

The support posts are preferably cylindrical, with an inverted L-shape in side elevation, and the guides are pivotally mounted on the door, so that the door may assume an overhead storage position. The inverted L-shape posts may have a support bracket for additional rigidity, and the guides have a mating slot through which the rod support brackets pass as the door is translated.

Yet another aspect of the present invention is an adjustable control console for bathing units of the type having a bathtub with at least one water dispenser, a seat area at one end of the bathtub, and a controller located at the other end of the bathtub to adjust the water dispenser. The adjustable console comprises a cabinet having a chassis, and a front plate facing the one end of the bathtub. The controller is mounted in the chassis, and includes a variable actuator portion which extends through the front plate of the cabinet, and is accessible to a user disposed in the seat area of the bathtub. A console support is connected with the bathtub, and slidingly mounts the cabinet at the other end of the bathtub for selective movement along a generally horizontal plane. A connector non-rigidly communicates the controller with a source of pressurized water, whereby the console is bodily translated along the support to adjust the fore-to-aft position of the console with respect to the seat area of the bathtub for a particular user, such that variously sized users can readily grasp and manipulate the actuator portion of the controller.

The adjustable control console preferably includes a handle which can be grasped by a seated user, so that the user may himself adjust the position of the console, without requiring an assistant. Furthermore, the console support preferably comprises a combination support and grab bar arrangement that facilitates entering and exiting the bathtub.

Yet another aspect of the present invention is a power door lock for bathing units of the type having a bathtub with an access opening, and a vertically translating door. The access opening has a wedge-shaped contour which mates with a similarly shaped sealing edge of the door. A compression seal is positioned between the lip portion of the bathtub and the sealing edge of the door to form a watertight seal therebetween. The power door lock comprises a lock pin connected with the door, which protrudes outwardly from the lower edge thereof. A latch arm is connected with the bathtub, and is shaped to matingly engage the lock pin when the door is in an initial, closed position. A power actuator mechanically moves the latch arm laterally into engagement with the lock pin, and thence moves the latch arm longitudinally, and pulls the lock pin and the door downwardly until the compression seal is seated securely between the lip of the bathtub and the sealing edge of the door to form a watertight seal therebetween.

Preferably, the power actuator comprises a hydraulic ram which operates from the water pressure available in the bathing unit. The door may have a spring loaded counterbalance which normally retains the door in a fully open position, and a snap lock to selectively retain the door in an initial, closed position in which the lock pin is aligned with the mating latch arm to insure proper engagement. The length of the lock pin may be adjustable to vary pressure on the compression seal, and a cam slide linkage may be used to shift the latch arm laterally and longitudinally.

The principal objects of the present invention are to provide a bathing unit that has total bathing and whirlpool for standard hygiene as well as hydrotherapy, and can be operated solely by the bather from within the bathtub, without the need for an assistant. The height of the door in the fully open position can be easily adjusted for a particular bather, so that the door is high enough that the bather can readily enter and exit the tub without bumping his head, yet is low enough that when the bather, when seated within the bathtub, can readily reach the door and manually raise and lower the same. A combination door guide and vertical grab bar arrangement makes it possible for even elderly or infirm bathers to easily raise and lower the door by themselves, and to safely enter and exit the bathing unit. An adjustable control console is slidingly supported on horizontal rods, so that the seated user can pull the entire console toward him for convenience during use, and then push the console back to a retracted, storage position to facilitate the user's unobstructed entry and exit from the bathing unit. Preferably, all of the controls for the bathtub, including mixer temperature control, drain control, flow control, whirlpool and areator controls, as well as the door lock controller are mounted on the adjustable console. A powered door lock is provided to securely lock the door in the closed and sealed position, without requiring any substantial manual effort on the part of the user. The bathing unit is efficient in use, capable of a long operating life, and particularly well adapted for home use.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
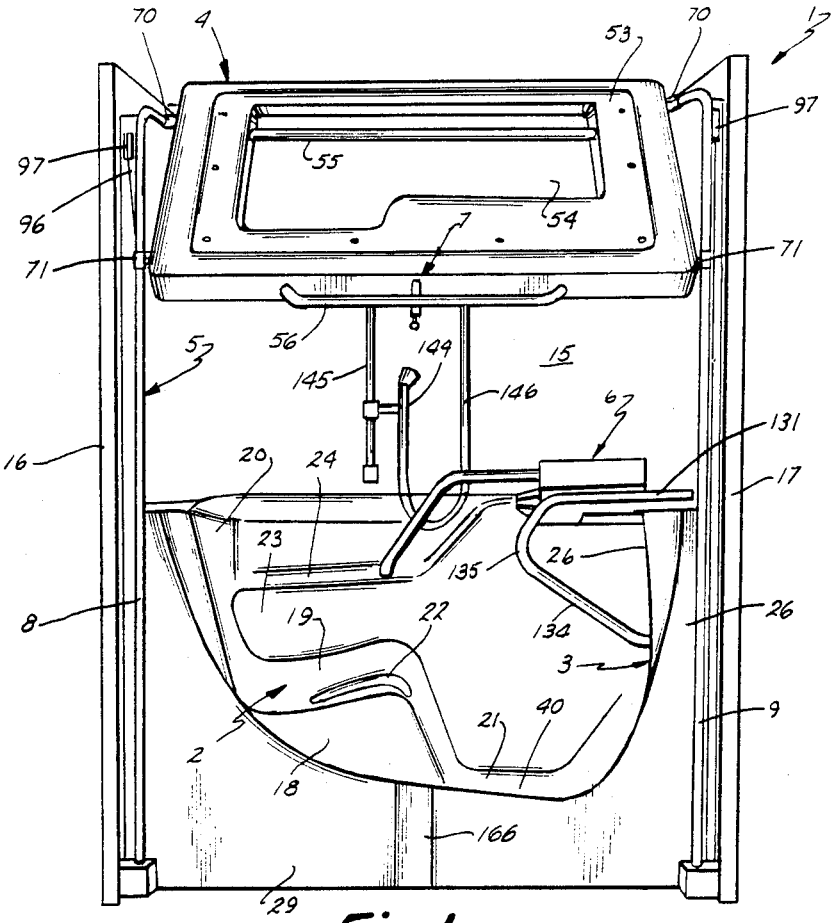
FIG. 1 is a front elevational view of a bathing unit embodying the present invention, with the door shown in an open position.

For purposes of description herein, the terms "upper," "lower," "right," "left," "rear," "front," "vertical," "horizontal," and derivatives thereof shall relate to the invention as oriented in FIG. 1, and in relation to a seated bather. However, it is to be understood that the invention may assume various alternative orientations, except where expressly specified to the contrary.

The reference numeral 1 (FIG. 1) generally designates a bathing unit, which is particularly designed for home use, and embodies the present invention. Bathing unit 1 includes a bathtub 2 with an access opening 3 in one side for ingress and egress, and a vertically sliding door 4 to selectively close access opening 3. Bathing unit 1 has a unique, combination door guide and grab bar arrangement 5, an adjustable control console 6, and a power door lock 7, all of which permit the bather to easily operate door 4 by himself and to adjust the water temperature, flow and whirlpool from a seated position within bathtub 2. The bather may thereby receive a total bathing and whirlpool experience in private, without the need for an assistant. The combination door guide and grab bar arrangement 5 includes a pair of support rods 8 and 9 located on either side of the access opening 3, which act both as a track on which door 4 smoothly and easily glides, and also as vertical grab bars which greatly facilitate safely entering and exiting the bathtub, without interfering with the operation of door 4. Adjustable control console 6 allows the seated bather to move the water controls to a convenient location within easy reach for bathing, and then retract the console to an out of the way storage position to facilitate entering and exiting the bathtub. The power door lock 7 securely closes door 4 to a fully closed and sealed position without significant manual effort, and includes a remote actuator 10 (FIG. 2) located on control console 6 to facilitate use of bathing unit 1 without an attendant.

Bathing unit 1 (FIG. 1) generally comprises a three-sided enclosure, including a rear wall 15, and left- and right-hand end walls 16 and 17, respectively. Bathtub 2 is disposed within enclosure walls 15–17, and preferably comprises a seat 18 having an anatomical contour. Seat 18 has a seat portion 19 disposed at an elevation substantially commensurate with conventional chair height, a back portion 20, and a footwell 21. Preferably, enclosure walls 15–17 and seat 18 are integrally molded in one piece from a durable, rigid, non-corroding material, such as fiberglass or the like. Seat portion 19 is inclined slightly to the rear, and includes a U-shaped trough or channel 22 disposed in the medial portion of the seat, and oriented longitudinally therein. Trough 22 extends from the middle of seat portion 19, and is anatomically shaped and positioned to expose the perineal area of a bather sitting on seat 18. The forward edge of seat portion 19 is rounded, and the rearward edge is arcuately shaped and blends smoothly with the back portion 20. Seat 18 includes lateral sidewalls 23 which extend upwardly from seat portion 19, and include ledges 24 which form armrests for the bather. Footwell 21 includes a drain 25 (FIG. 10) with a conventional shutoff valve.

Bathtub 2 (FIG. 2) has a front wall 26 which is oriented generally vertically, and includes a central notch 27 in which adjustable control console 6 is received in a retracted, storage position. The front wall 26 of bathtub 2 tapers inwardly and downwardly to the base of footwell 21. A ledge 28 is formed around the upper edge or rim of bathtub 2, and a forward side panel 29 (FIG. 1) extends from the floor upwardly to access opening 3.

Figure 12:
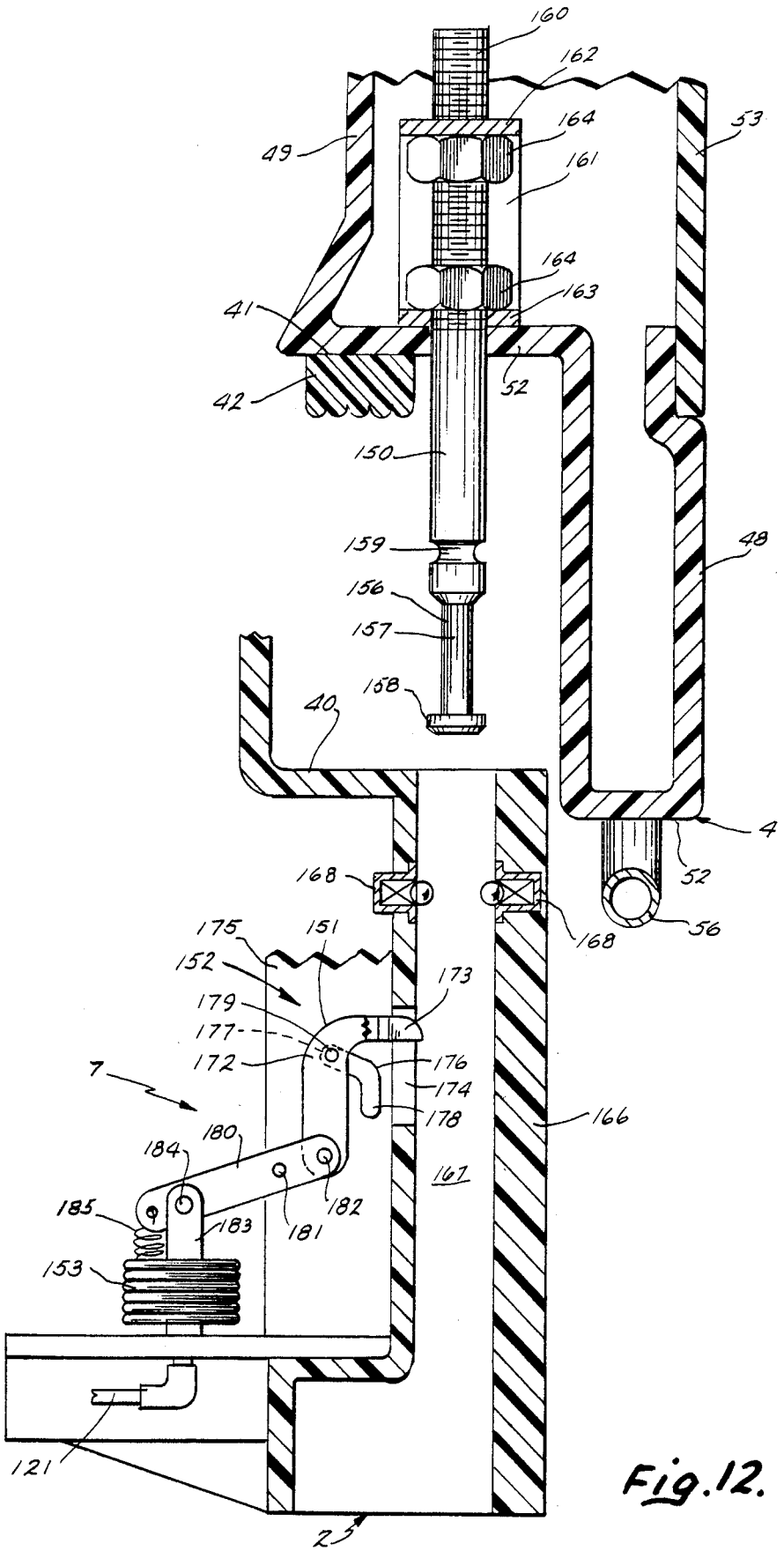
FIG. 12 is a fragmentary, vertical cross-sectional view of the bathing unit, particularly showing a power door lock, wherein the door is shown in a partially open position.
Figure 15:
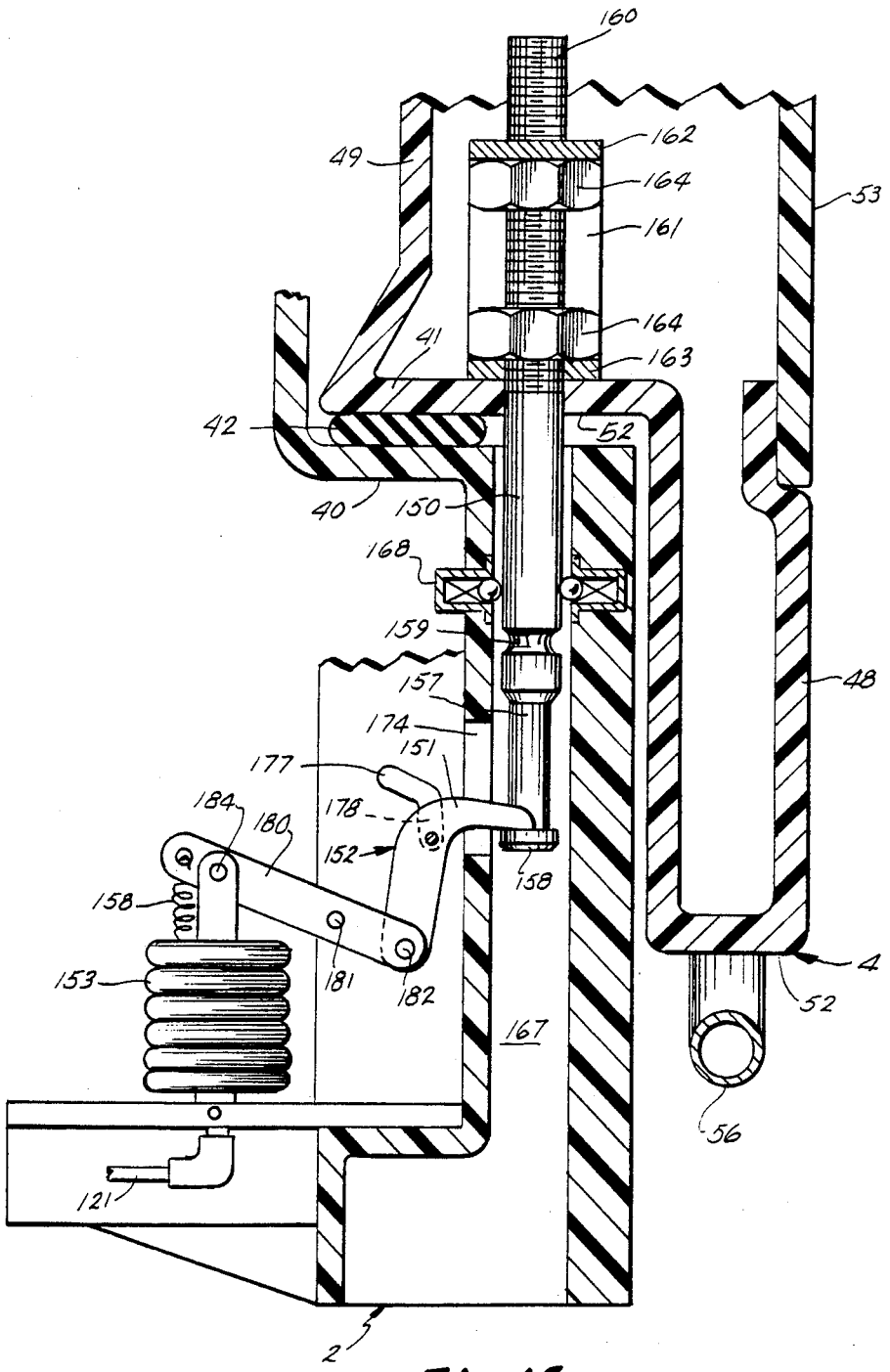
FIG. 15 is a vertical cross-sectional view of the bathing unit and the power door lock, wherein the door is shown in a fully closed and sealed position.
Figure 16:
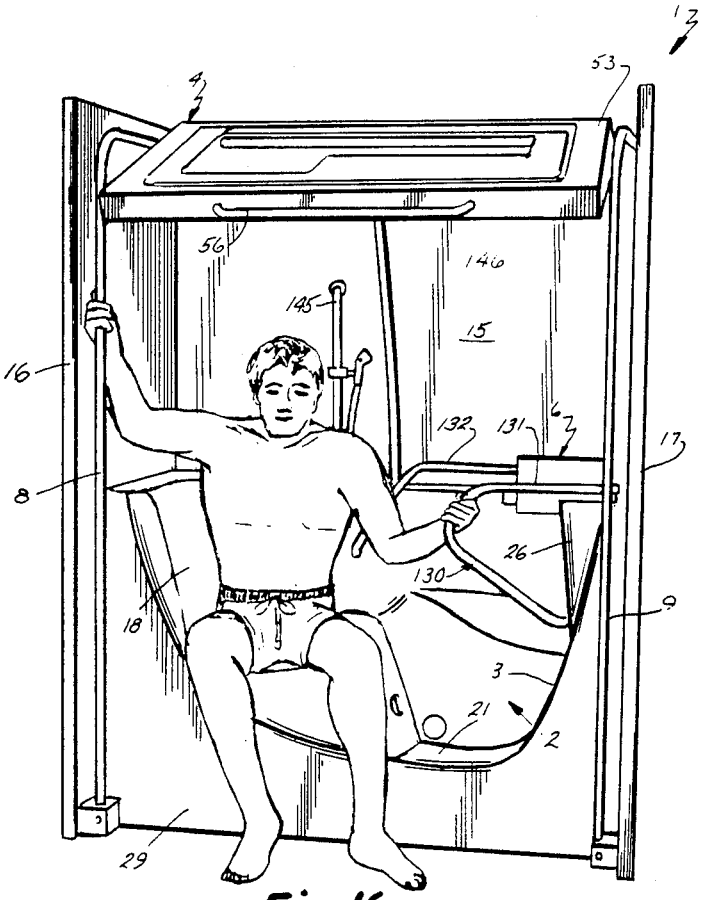
FIG. 16 is a front elevational view of the bathing unit, wherein a bather is shown seated in a bathtub portion of the bathing unit.
Figure 17:
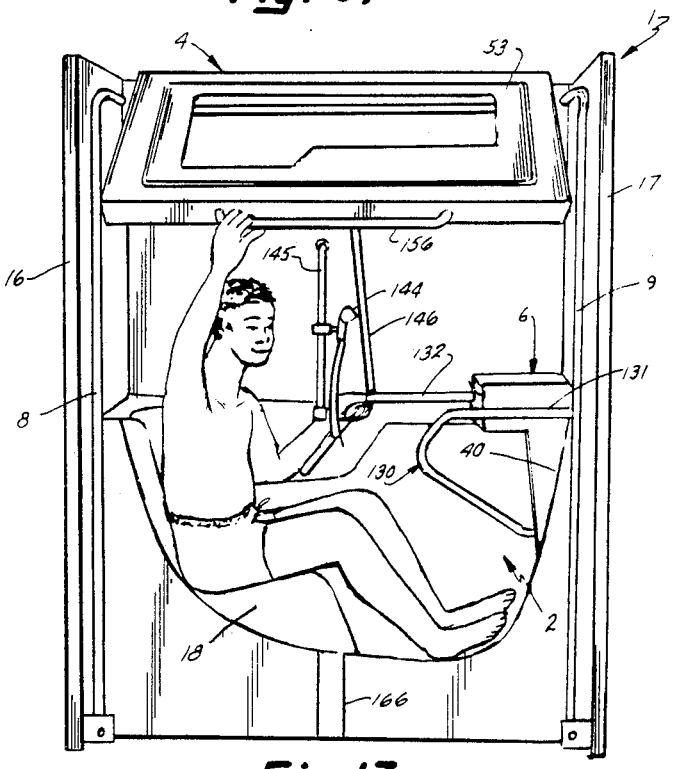
FIG. 17 is a front elevational view of the bathing unit, wherein a bather is shown seated in the bathtub, and grasping the door to lower the same.

In the illustrated bathing unit 1, access opening 3 is oriented laterally, and is defined by a lip 40 (FIG. 1), having an upwardly opening, wedge-shaped contour. Door 4 includes a wedge-shaped sealing edge 41 (FIG. 12) on the interior side thereof, which conforms to the contour of lip 40. A compression seal 42 is positioned between the lip 40 on bathtub 2, and the sealing edge 41 of door 4, such that when door 4 is fully closed, as shown in FIG. 15, seal 42 is compressed to form a watertight seal therebetween. Lip 40 and sealing edge 41 preferably have a generally arcuate front elevational shape, as best illustrated in FIGS. 1 and 16–17. In the illustrated example, lip 40 and sealing edge 41 have a nearly semicircular, front-elevational shape to facilitate substantially uniform compression of seal 42 about the sealing edge of door 4.

Door 4 (FIGS. 3 and 4) has a generally rectangular shape, and includes a front panel 48, an interior panel 49, opposite side edges 50, and upper and lower edges 51 and 52, respectively. The right-hand portion of bathtub 2 is integrally molded on the interior panel 49 of door 4, so that when door 4 is open, the right-hand side of seat 18 is fully open and exposed to facilitate entering and exiting bathtub 2. The front panel 48 of door 4 has an opening therein to access the interior of door 4 to adjust power door lock 7, and for other purposes to be described hereinafter. A removable cover 53 is detachably mounted over the access opening in door 4 by suitable means, such as threaded fasteners, or the like. In this example, removable cover panel 53 (FIG. 1) includes a recess 54 with a towel rack 55 mounted therein. An elongated, cylindrical grab handle 56 is attached to the lower edge 52 of door 4, and protrudes outwardly therefrom to facilitate grasping the door and manually manipulating the same between the open and closed positions.

Figure 6:
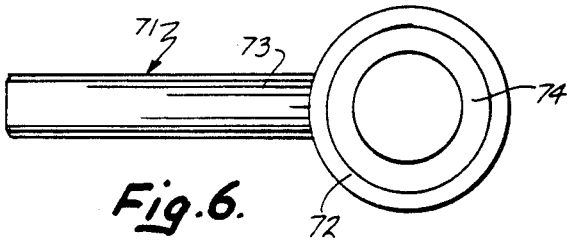
FIG. 6 is a top plan view of a lower door guide portion of the bathing unit.
Figure 7:
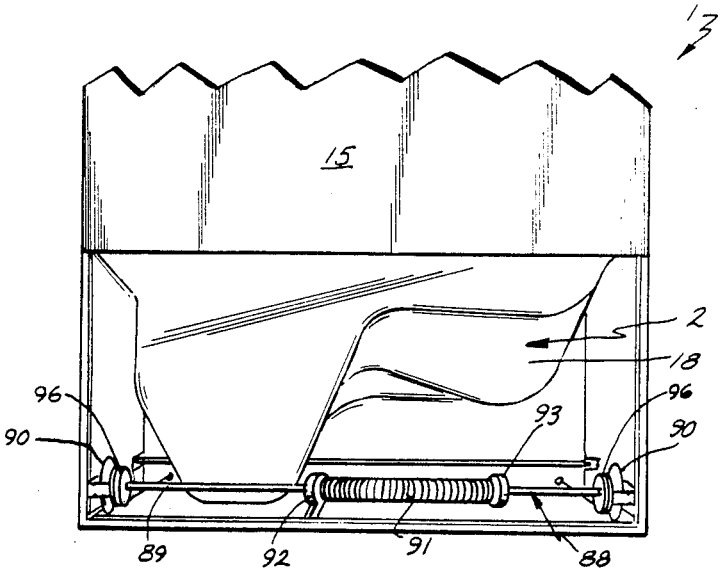
FIG. 7 is a fragmentary, rear elevational view of the bathing unit, particularly showing a counterbalance spring arrangement for the door.
Figure 8:
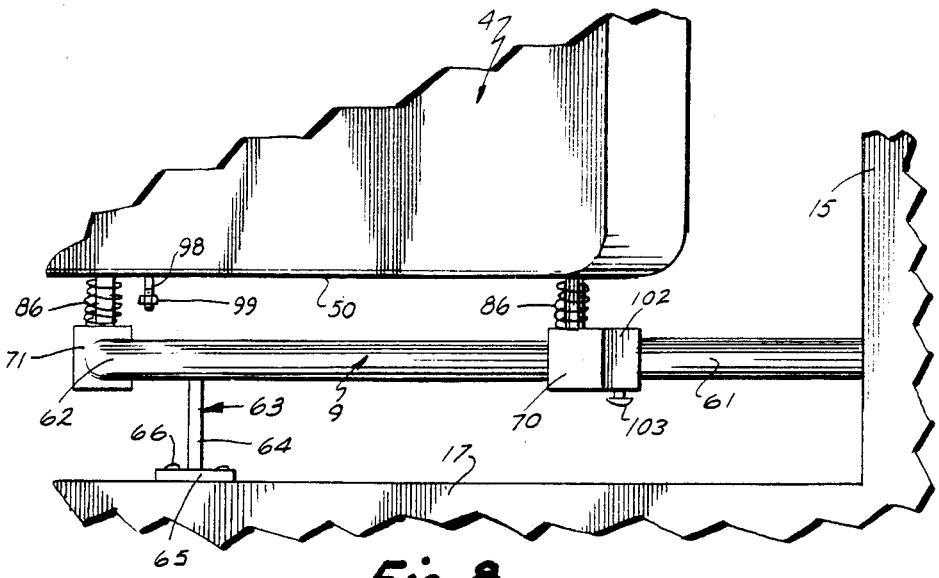
FIG. 8 is a fragmentary, partially schematic, top plan view of the bathing unit, with the door shown in the open position.
Figure 9:
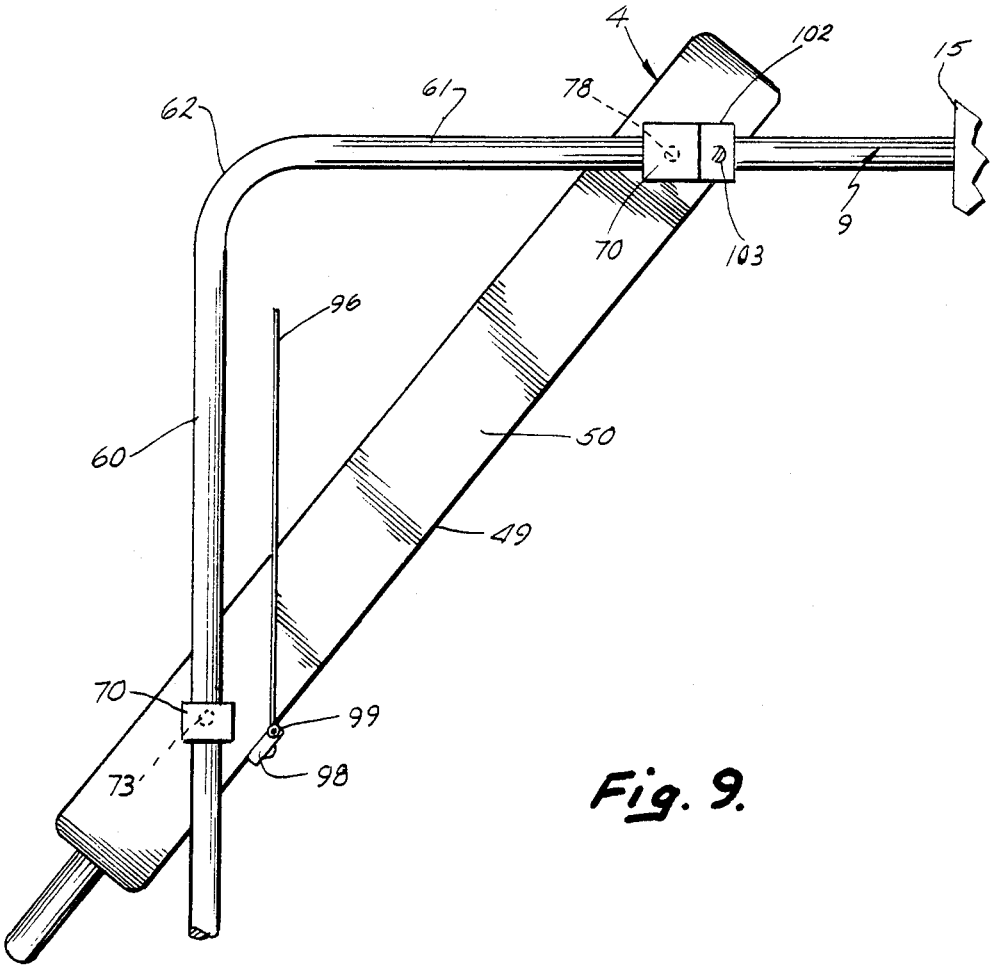
FIG. 9 is a fragmentary, partially schematic, side elevational view of that portion of the bathing unit illustrated in FIG. 8, with the door shown in the same, open position.

The combination door guide and grab bar arrangement 5 is best illustrated in FIGS. 1–9. Support posts 8 and 9 are mounted in bathing unit 1 adjacent the opposite side edges 50 of door 4, and extend in a mutually parallel, and generally vertical orientation. In the illustrated example, support posts 8 and 9 (FIGS. 8 and 9) are cylindrical, and have an inverted L-shape in side elevation, comprising a straight vertical leg 60, a straight horizontal leg 61, and a curved intermediate portion 62. The lower ends of support rods 8 and 9 are fixedly mounted in the base of bathing unit 1. The upper ends of support rods 8 and 9 are fixedly mounted in the rearwall 15 of bathing unit 1. As shown in FIG. 8, support braces 63 are attached to support rods 8 and 9 near the forward ends of horizontal legs 61. Braces 63 are generally T-shaped and include a flat, laterally extending plate 64, and a base plate 65 which is fastened to the enclosure end walls 16 and 17 by fasteners 66. Braces 63 provide support posts 8 and 9 with lateral rigidity so that the support rods will remain accurately aligned, and door 40 will glide smoothly between the open and closed positions. Support rods 8 and 9 preferably have a smooth exterior surface, and are constructed of a very durable, water resistant material, such as chrome plated tubing, or the like.

As best illustrated in FIG. 16, the vertical legs 60 of support rods 8 and 9 are completely open or freestanding, so that they function as vertical handles or grab bars. The vertical rod legs 60 are spaced outwardly from enclosure end walls 16 and 17, as well as front panel 29, so that the bather's hand can easily grasp the rods at any location along their length. Braces 63 insure that the vertical rod legs 60 are sufficiently rigid to function as grab bars, and are located at the top of the unit, so that they do not interfere with the bather's grip on the rods. When door 4 is open, the vertical rod legs 60 are located immediately adjacent to the sides of access opening 3, so that they are handy to grasp as the bather enters and exits bathing unit 1. Heretofore, it has not been possible to position grab bars at a convenient location near the access opening 3, because they obstruct or interfere with the operation of door 4. In the present invention, the vertical rod legs 60 not only do not interfere with the operation of door 4, but they actually function as an integral part of the door guide mechanism.

Two pairs of guides 70 and 71 (FIGS. 3 and 4) are mounted on the opposite side edges 50 of door 4, and are telescopingly received over support rods 8 and 9 for sliding translation therealong. Preferably, at least the upper pair of guides 70 are pivotal with respect to door 4, so that the door may assume an overhead storage position, as illustrated in FIG. 1. In the illustrated bathing unit 1, both pairs of guides 70 and 71 are pivotally mounted in door 4, to assure smooth operation, and so that door 4 can assume a fully overhead storage position if the same is desired.

With reference to FIG. 6, the lower guides 71 comprise a hollow, cylindrical housing 72 with a mounting pin 73 fixedly attached to housing 72, and extending radially outwardly therefrom. An annularly shaped, antifriction insert 74 is mounted within housing 72, and is sized to be closely received over an associated one of the support rods 8 and 9. Insert 74 may be constructed of a suitable self-lubricating material, such as nylon, or the like.

The upper guides 70 (FIG. 5) are substantially similar in construction to the lower guides 71, and include a hollow, cylindrical housing 77, a mounting pin 78 connected with housing 77, and an antifriction insert 79. The upper guides 70 include a slot 80 through the housing 77 and insert 79 at a location diametrically opposed from pin 78. Slot 80 is slightly larger in width than the thickness of the brace plate 64 on the support rod braces 63, so that the upper guides 70 can pass over the support rod braces 63 when the door is raised to an overhead storage position.

Figure 3:
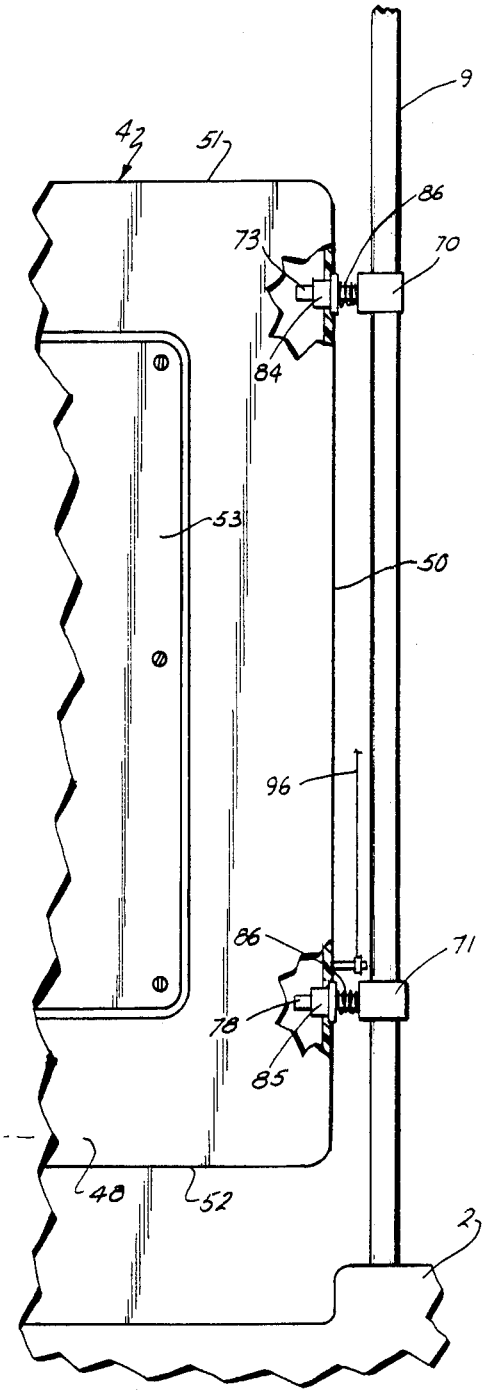
FIG. 3 is a fragmentary, front elevational view of the bathing unit, particularly showing a combination door guide and grab bar arrangement, with the door shown in a closed position.
Figure 4:
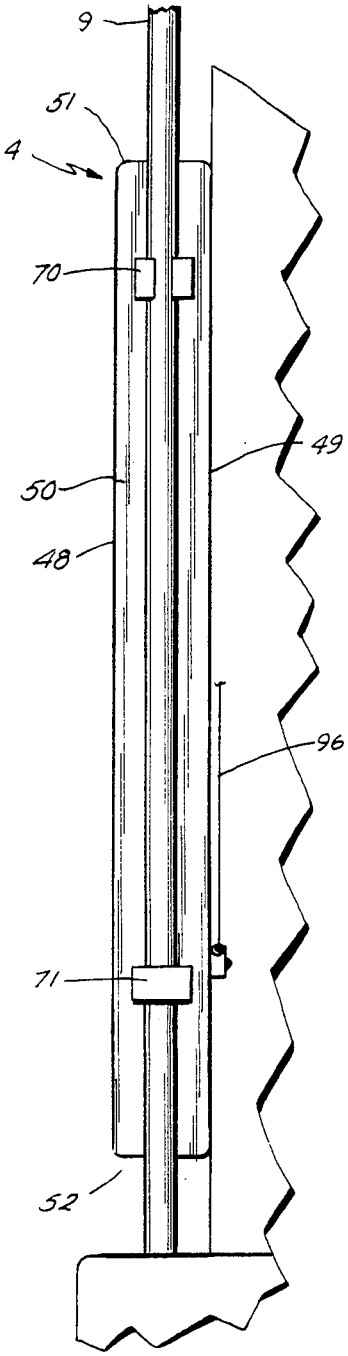
FIG. 4 is a fragmentary, side elevational view of the bathing unit shown in FIG. 3, wherein the door is also shown in the closed position.
Figure 5:
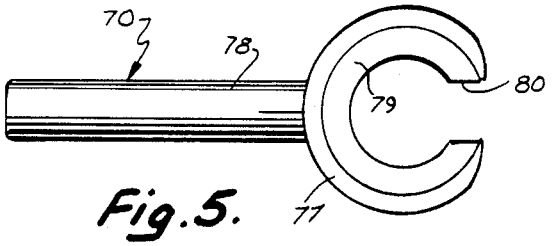
FIG. 5 is a top plan view of an upper door guide portion of the bathing unit

As best illustrated in FIG. 3, a pair of self-lubricating bushings 84 are mounted in the side edges 50 of door 4 adjacent the upper edge 51 of the door. Bushings 84 include a central aperture in which in the mounting pins 73 of the upper guides 70 are closely received to rotatably mount the guides 70 with respect to door 4. A second pair of antifriction bushings 85 are mounted in the side edges of door 4 adjacent the lower edge 52 thereof. Bushings 85 also include central apertures in which the pins 78 of the lower guides 71 are received to rotatably mount guides 71 therein. Coil springs 86 are positioned over the mounting pins 73 and 78 of the upper and lower guides 70 and 71 between the associated housing and bushings 77 & 84 and 72 & 85, respectively, and urge the sides of door 4 inwardly, so that door 4 "floats" laterally on guides 70 and 71. This floating action provides smooth, non-binding translation of the door, and also self-aligns the sealing edge 41 of door 4 with the mating lip 40 of bathtub 2.

With reference to FIG. 7, a spring loaded counterbalance mechanism 88 is provided to resiliently retain door 4 in a normally open position. Counterbalance 88 is mounted within the interior of bathtub 2, and includes an elongate axle 89 rotatably mounted along the rearward edge of bathtub 2. A pair of take-up drums 90 are attached to the opposite ends of axle 89, and a coil spring 91 is positioned over a medial portion of axle 89. One end of spring 91 is held stationary by a bracket 92, and the opposite end of spring 91 is connected to axle 98 by an adjustable collar 93. Rotation of collar 93 with respect to axle 89 varies the rotational torque applied to the pick-up drums 90 by spring 91.

Flexible lines 96 are connected to and wrapped around both take-up drums 90. Flexible lines 96 extend from take-up drums 90, through the interior of bathing unit 1, to pulleys 97 (FIG. 1) mounted in the upper, forward portions of enclosure walls 16 and 17. Brackets 98 (FIGS. 8 and 9) are attached to the rear panel 49 of door 4, adjacent the lower guides 71. Brackets 98 extend laterally outwardly from the side edges 50 of door 4, and swivel eyelets 99 rotatably attach the ends of flexible lines 96 to brackets 98. As door 4 is moved downwardly toward the closed position, the pulling force is transmitted to flexible lines 96, which in turn rotates take-up drum 90, and tenses spring 91. When door 4 is released, the rotational torque stored in spring 91 tenses flexible lines 98, and pulls door 4 upwardly to the normally open position illustrated in FIGS. 1, 8 and 9.

The fully open position of door 4 is preferably adjustable to accommodate the particular individual or individuals using bathing unit 1. In the fully open position, door 4 should be sufficiently high to permit the user to readily enter bathing unit 1 through access opening 3, without bumping his head, as shown in FIG. 16. Yet, door 4 should be low enough in the fully open position to permit the user seated on seat 18 to readily reach and grasp handle 56, as shown in FIG. 17, so as to pull door 4 closed.

The fully open position of door 4 can be adjusted by simply varying the tension applied to door 4 by counterbalance 88. This adjustment can be achieved by either rotating adjustable collar 93, or by varying the effective length of flexible lines 96 by repositioning the same on take-up drums 90.

A positive stop 102 (FIGS. 8 and 9) may be provided to positively maintain door 4 in a preselected, fully open position. In general, stop 102 comprises a device, such as a clamp, split sleeve, or the like, which is positioned to cause abutment between door 4 and a stationary portion of bathing unit 1 to prevent door 4 from opening further. The illustrated stop 102 comprises a hollow cylindrical sleeve, which is closely received over support 9. A set screw 102 is threadedly engaged in the sidewall of stop 102, and abuts the exterior surface of support rod 9 to detachably lock stop 102 in a particular position. In the example illustrated in FIGS. 8 and 9, stop 102 is positioned on the medial portion of the horizontal leg 61 of support rods. Preferably, an identical stop 102 is positioned on the horizontal leg of the opposite support rod 8. Counterbalance 88 is adjusted so as to apply light tension to flexible lines 96 when door 4 is in the positively stopped, fully open position, such that door 4 will automatically return to the desired location through the force of spring 91.

Figure 2:
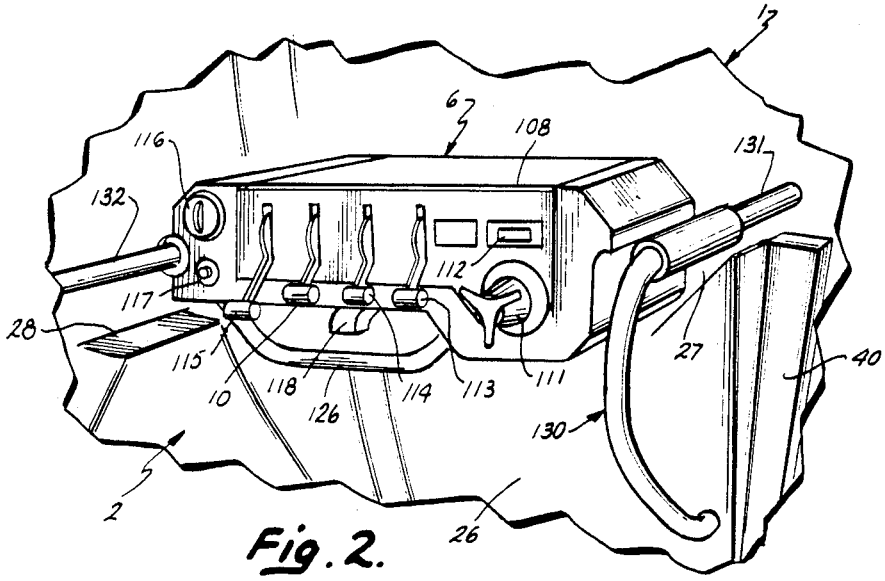
FIG. 2 is a perspective view of an adjustable control console portion of the bathing unit.
Figure 10:
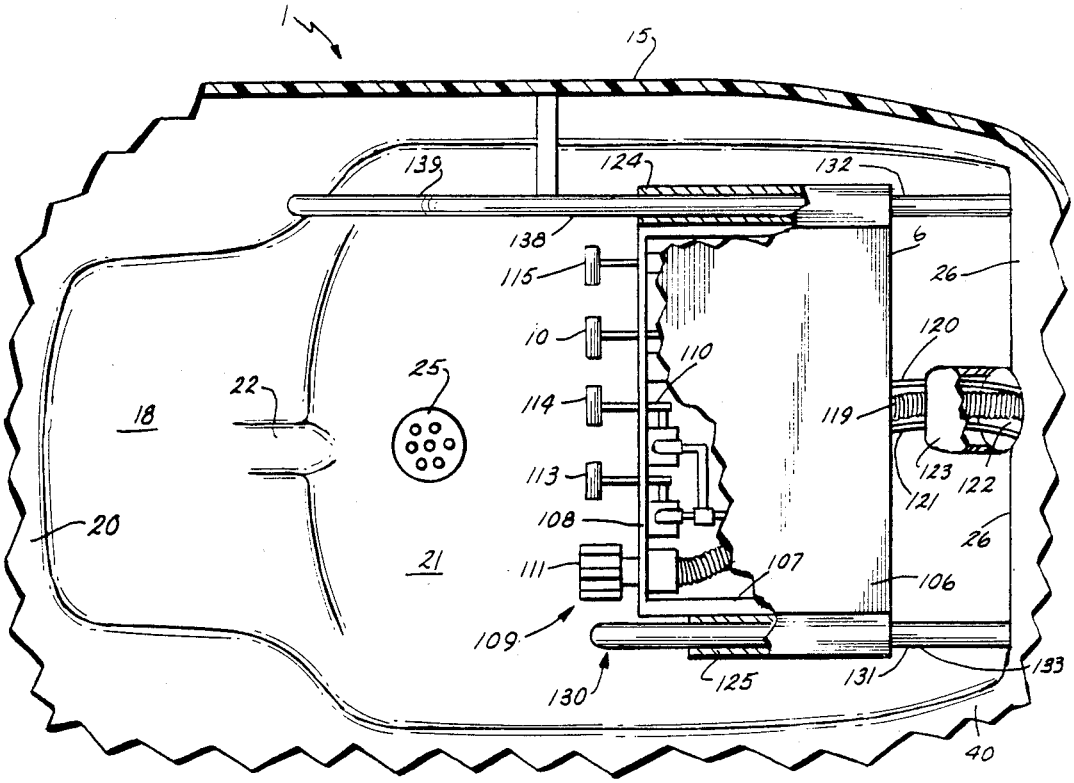
FIG. 10 is a fragmentary, top plan view of the bathing unit, particularly showing the adjustable control console, which is illustrated in an outwardly extended position.
Figure 11:
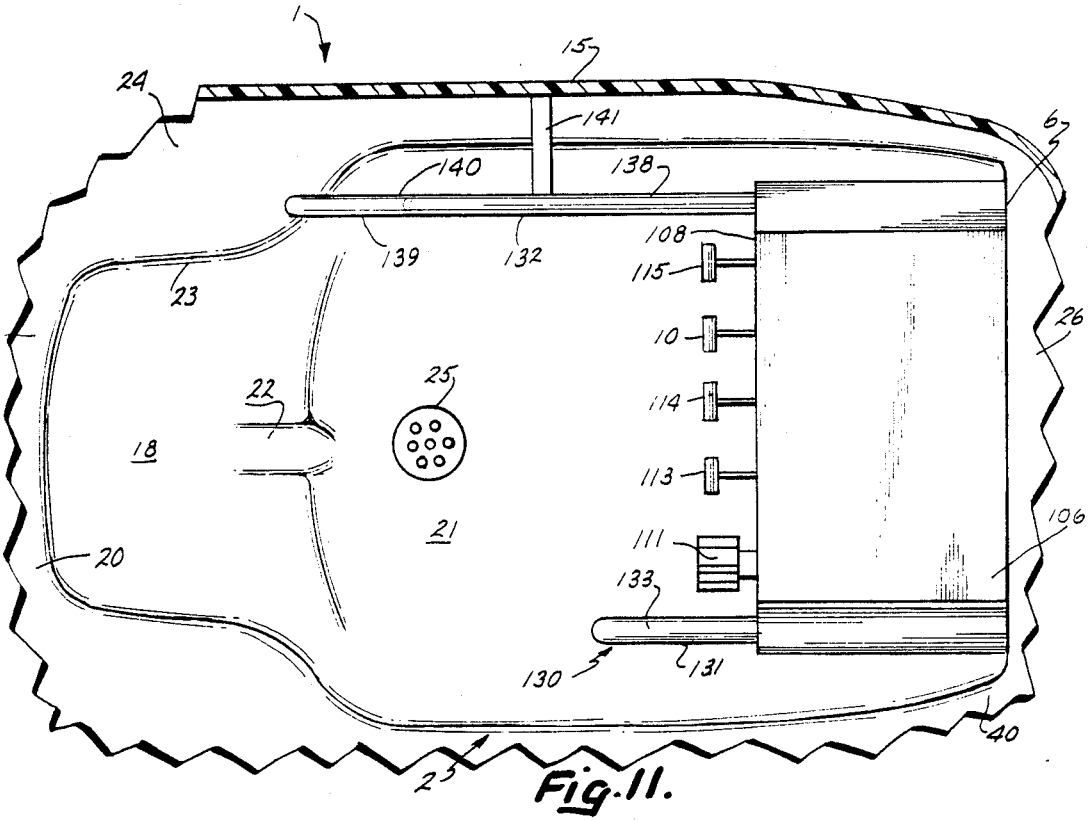
FIG. 11 is a fragmentary, top plan view of the bathing unit shown in FIG. 10, with the adjustable control console shown in a retracted, storage position.

The adjustable control console 6 is best illustrated in FIGS. 2, 10 and 11. Control console 6 comprises a cabinet 106 (FIGS. 10 and 11) having a chassis 107, and a front plate 108. A plurality of controllers 109 are mounted in cabinet 106, and include actuator levers 110, which extend through front plate 108, and are accessible to a bather positioned on seat 18. In the illustrated example, adjustable console 6 includes a hot/cold water mixer valve 111, a tub-fill valve 113, a shower valve 114, the door lock actuator 10, a bowden cable controller 115 for drain valve 25, and a water temperature indicator 112 (FIG. 2). Adjustable console 6 also includes a whirlpool controller 116, and an aerator controller 117, which extend through front plate 108. A tub fill spout 118 is connected with a lower, rear portiion of the console chassis 107, and is oriented toward the left-hand sideall 22 of bathtub 2 to alleviate splashing. Each of the individual water controllers 111–117, as well as tub fill spout 118, and door controller 10 is non-fixedly connected with their associated actuator by means such as flexible plumbing lines, bowden cables, and the like, so that console 6 can be translated fore-to-aft in bathtub 2, without interfering with the controls. For example, tub-fill valve 113, and shower valve 114 are in the nature of ball valves, and together with mixer valve 111 are communicated with sources of pressurized hot and cold water through flexible plumbing line 119 (FIG. 10). A bowden cable 120 connects controller 115 with the drain valve 25. As described in greater detail hereinafter, door lock valve 10 is in the nature of a ball valve, and controls the communication of water pressure to a door lock actuator through a flexible plumbing line 121. All of the actuator lines, including lines 116, 117 and 118 extend from the rear of cabinet 106, through an aperture 122 in the front wall 26 of bathtub 2. An arcuately shaped tube or hood 123 encircles aperture 122, to insure that lines 119, 120 and 121 do not bind as console 6 is moved during adjustment.

Controllers 113, 114, 115 and 10 are all lever operated, and are shifted between the open and closed positions by a vertical motion. This type of control action permits the controller to be adjusted by bathers that have limited dexterity in their fingers, such as patients with arthritis, and the like, since it is not necessary to grasp the controller in order to adjust it.

A pair of hollow guides 124 and 125 are mounted on the opposite sides of cabinet 106, and are adapted to slidingly support console 6 for translation along a substantially horizontal plane. Guides 124 and 125 preferably include antifriction bushings, such as nylon sleeves, or the like (not shown) to help console 6 slide smoothly. A handle 126 (FIG. 2) is attached to the lower, forward portion of cabinet 106, and is adapted to be grasped by a bather seated on seat 18 to facilitate adjustment of console 6, without requiring an assistant.

The support device for console 6 preferably comprises a combination support and grab bar arrangement 130 (FIGS. 10 and 11), having left- and right-hand support posts 131 and 132, respectively. The right-hand support post 131 is mounted in the front wall 26 of bathtub 2 at the right-hand side thereof, adjacent lip 40. The right-hand support post 131 comprises a straight, horizontally oriented upper leg 133, with the free end securely mounted in front wall 26. The right-hand guide 125 on console cabinet 106 is closely received over the upper leg 133 of support post 131 for sliding translation therealong. Support post 131 also includes an inclined lower leg 134 (FIGS. 1 and 2), which has its free end securely mounted in front wall 26 at a location near lip 40, and below upper leg 133. The right-hand support post 131 includes an arcuately shaped intermediate portion 135, which interconnects the upper and lower legs 133 and 134, and forms a grab handle which protrudes outwardly toward the seat 18 of bathtub 2.

The left-hand support post 132 (FIGS. 10 and 11) also includes a straight, horizontally oriented upper leg 138, having a free end mounted securely in front wall 26, at a location adjacent the rear wall 15. The left-hand guide 124 of cabinet 106 is telescopingly received over the upper leg 138 of support post 132, and slidingly supports console 6 for translation therealong. The left-hand support post 132 also includes a straight, downwardly inclined lower leg 139, with one end mounted in the left-hand sidewall 23 of bathtub 2, adjacent the left-hand armrest ledge 24. An arcuately shaped intermediate section 140 of support post 132 interconnects the upper and lower legs 138 and 139 respectively. A lateral support rod 141 has one end connected with the outer end of upper leg 138, and the other end fixedly mounted in the rear wall 15 of bathing unit 1. The lower leg 139 of left-hand support post 132 forms an elongate handle which a bather seated on seat 18 may easily grasp with his left hand.

Adjustable control console 6 glides horizontally on support posts 131 and 132 to adjust its fore-to-aft position within bathtub 2, particularly with respect to seat 18. The cabinet 106 of console 6 is shaped to be received in a mating notch 27 in the front wall 26 of bathtub 2 when the console is in a retracted, storage position, as shown in FIG. 11. This permits the bather to enter and exit bathtub 2 without any obstructions. The seated bather may pull adjustable control console 6 outwardly from the retracted, storage position to a convenient operating position, as shown in FIG. 10.

A "telephone" type shower head or wand 144 (FIG. 1) is mounted on the rear wall 15 of bathing unit 1 by a vertical bracket 145. A flexible tube 146 connects shower head 144 with a source of pressurized water through controller valve 114 on adjustable console 6.

Figure 13:
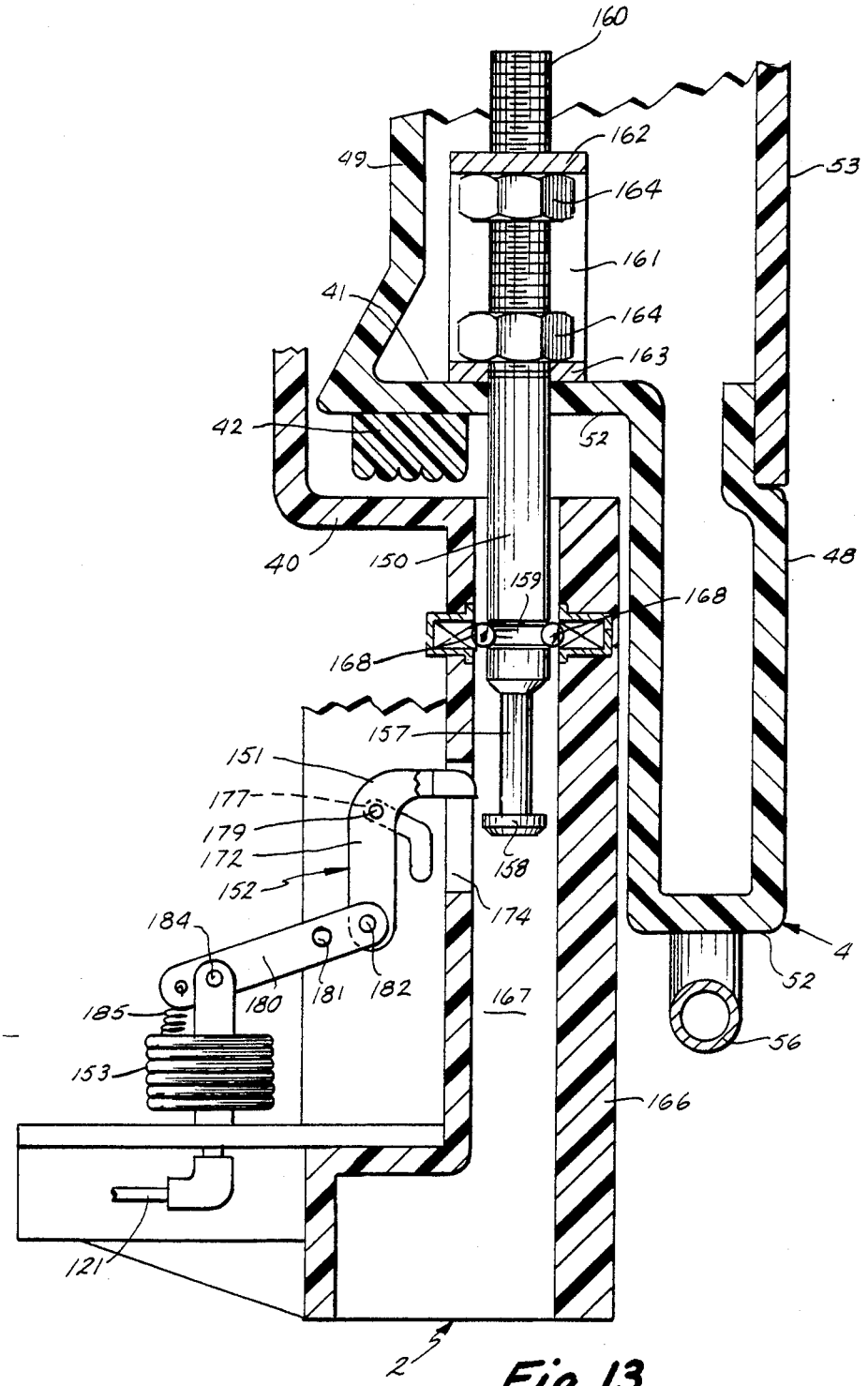
FIG. 13 is a fragmentary, vertical cross-sectional view of the bathing unit and power door lock, wherein the door is shown in an initial, closed position.

As best illustrated in FIGS. 12–15, door lock 7 comprises a lock pin 150, which is connected with door 4, and projects outwardly from the lower edge 52 thereof. A latch arm 151 is connected with bathtub 2 at a lower, forward portion thereof, and is shaped to matingly engage with lock pin 150 when door 4 is in an initial closed position, as shown in FIG. 13. A cam slide linkage 152, powered by a hydraulic cylinder or jack 153 moves latch arm 151 laterally out into engagement with lock pin 150, and pulls lock pin 150 and door 4 downwardly until compression seal 42 is securely seated between the lip 40 of bathtub 2 and the sealing edge 41 of door 4, as shown in FIG. 15.

The only portion of power door lock 7 contained within door 4 is lock pin 150, and its associated mounting arrangement. Hence, the door 4 itself does not carry any linkage or mechanical lock, as contemplated by the in-door lock arrangements for institutional bathing units, as disclosed in our prior U.S. Pat. Nos. 4,346,485; 4,446,586 and 4,399,569. Furthermore, door 4 does not contain any plumbing for spray nozzles, or the like, as disclosed in our prior U.S. Pat. No. 4,439,877. The overall weight of door 4 is thereby reduced to a minimum, so that the effort required to raise and lower door 4 is reduced accordingly to adapt the bathing unit 1 for unassisted, home use.

Lock pin 150 comprises a cylindrically-shaped rod, having a elongate, annular slot or groove 156 adjacent the free end of lock pin 150, so as to define shank and head portions 157 and 158 respectively of lock pin 150. An arcuately shaped annular groove 159 is provided in lock pin 150 at a location spaced upwardly from slot 156, to form one-half of a snap-lock, which is described in greater detail hereinafter.

The upper end 160 of lock pin 150 is threaded, and is mounted within the interior of door 4, through sealing edge 41, near the vertical center line of door 4. Lock pin 150 is preferably mounted in door 4 so that its effective length can be adjusted to vary the sealing pressure applied to compression seal 42. In the illustrated example, a rectangularly-shaped bracket 161 is positioned within the interior of door 4, and is fixedly connected with the adjacent surfaces thereof. Bracket 161 includes vertically aligned apertures through its upper and lower plates 162 and 163 respectively, and a pair of threaded nuts 164 are positioned on that portion of the threaded lock pin end 160 disposed between bracket plates 162 and 163. Nuts 164 are tightened outwardly against the upper and lower plates 162 amd 163 of bracket 160 to securely, yet adjustably anchor lock pin 150 in door 4.

A semicircular, vertically oriented sleeve or column 166 is formed in the front wall 29 of bathtub 2, in vertical alignment with lock pin 150. Column 166 includes a cylindrical aperture 167 extending through its center, which is shaped to closely receive lock pin 150 therein. A pair of spring loaded, ball retainers 168 are mounted in an upper portion of column 166, and are adapted to engage the mating groove 159 in lock pin 150 so as to hold door 4 in the initial closed position shown in FIG. 13, against the tension of the spring counterbalance 88, so that latch arm 151 will be in proper lateral alignment with lock pin 150 to fully close and lock door 4.

Latch arm 151 has a plate-shaped body 172, with a fork or claw 173 located at the upper end thereof, which extends through a mating slot 174 into the center aperture 167 of column 166. Claw 173 includes a pair of prongs, which are laterally spaced apart, and are shaped to be received over the shank 157 of lock pin 150, and to engage the lock pin head 158. The latch arm body 172 is slidingly received and retained between a pair of parallel bracket plates 175 that are fixedly connected with bathtub 2. Bracket plates 175 include a pair of transversely aligned slots 176, having a laterally extending, downwardly inclined upper leg 177, and a vertically extending lower leg 178 communicating therewith. A laterally extending pin 179 is mounted in the body portion 172 of latch arm 151, and the opposite ends of pin 179 extend through the aligned slots 176 to form a cam and a cam follower that shifts latch arm 151 laterally outwardly and downwardly in a predetermined pattern and sequence. A link 180 is pivotally mounted between bracket plates 175 at a medial portion of the link by a pin 181. One end of link 180 is pivotally connected with the lower end of latch arm body 172 by a pin 182. Hydraulic jack 153 has a stationary base attached fixedly to the frame of bathing unit 1, and an upper, reciprocating rod end 183 pivotally attached to the opposite end of link 180 by a pin 184. A return spring 185 has one end connected with the outwardly protruding end of link 180, and the other end is connected with a stationary surface, such as the frame of bathing unit 1. Preferably, hydraulic jack 153 is actuated by pressurized water which is available in the bathing unit, and in the illustrated example, hydraulic jack 153 communicates with actuator valve 10 through flexible plumbing line 121.

Figure 14:
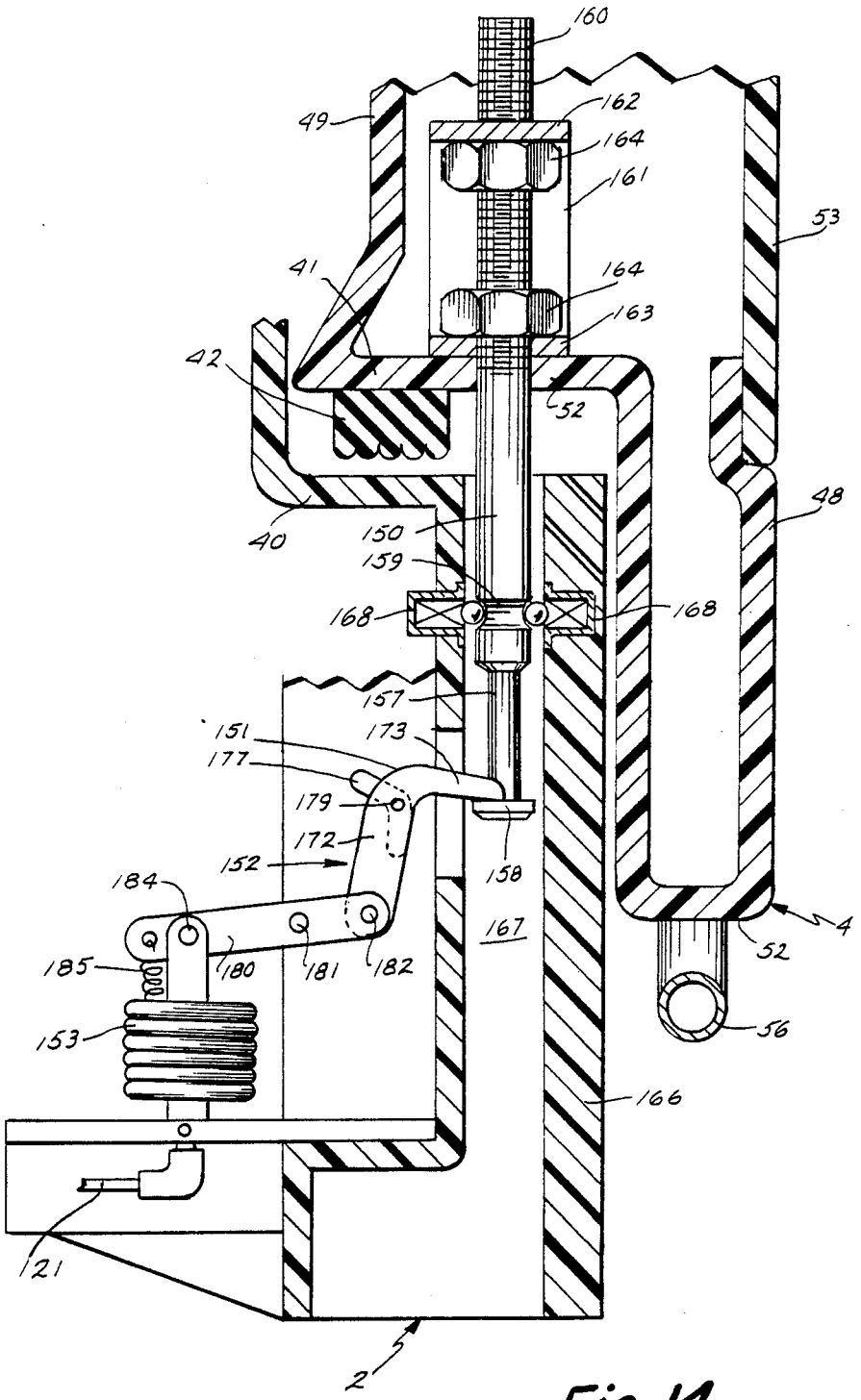
FIG. 14 is a vertical cross-sectional view of the bathing unit and the power door lock, wherein the door is shown in the initial closed position, and a latch arm portion of the lock is engaged with the door.

In operation, door lock 1 functions in the following manner. Door 4 is lowered until spring loaded latch balls 168 are engaged in the mating groove 159 of lock pin 150, as illustrated in FIG. 13. The snap-lock formed by latch balls 168 retains door 4 in place against the force of the spring loaded counterbalance 88 in a predetermined position, in which the claw 173 of latch arm 151 is aligned with the shank portion 157 of lock pin 150. To lock door 4, the user simply shifts door valve actuator 10 to the open position, thereby communicating pressurized water with hydraulic jack 153. The reciprocating end 183 of the jack is thereby forced upwardly, and link 179 is rotated in a clockwise direction, as viewed in FIGS. 12–15. The rotating motion of link 180 exerts a downward force on the lower end of latch arm 151, causing the upper end of latch arm 151 to move laterally outwardly and downwardly as cam pin 179 follows the upper legs 177 of cam slots 176. The claw portion 173 of latch arm 151 is thereby moved laterally outwardly over the shank 157 of lock pin 150, and into engagement with the lock pin head 158, as illustrated in FIG. 14. Continued rotation of link 180 pulls cam pin 179 downwardly along the lower legs 178 of cam slots 176. The latch arm claw 173 thereby pulls lock pin 150 downwardly, thereby compressing seal 42 securely between the lip 40 of bathtub 2, and the sealing edge 42 of door 4, as illustrated in FIG. 15. As long as the door lock controller valve 10 remains open, the closing force exerted on door 4 by hydraulic jack 153 will continue, thereby securely locking door 4 in place. Hydraulic jack 153 preferably includes a check valve or back flow preventor, which will insure that the pressure in hydraulic jack 153 is maintained, even if there is a temporary interruption of water pressure. Furthermore, when door 4 is fully closed, and bathtub 2 is filled with water, the hydraulic pressure from the water in the tub which acts laterally on door 4 causes lock pin 150 to engage the outer surface of mating column 166 to resist these forces. The frictional forces that thereby develop between lock pin 150 and column 166 will retain door 4 in the fully closed and sealed position, even if door lock 7 is inadvertently released.

After bathtub 2 has been drained, to release door lock 7, the bather simply closes valve controller 10, thereby removing the water pressure acting on hydraulic jack 153. Return spring 185, in conjunction with the resiliency of compression seal 42, rotates link 180 in a counterclockwise direction, as viewed in FIGS. 12–15, thereby raising latch arm 151 and moving claw 173 laterally outwardly from engagement with the lock pin head 158. Door 4 is then lifted upwardly manually, with the assistance of counterbalance 88, to the fully open position.

Figure 18:
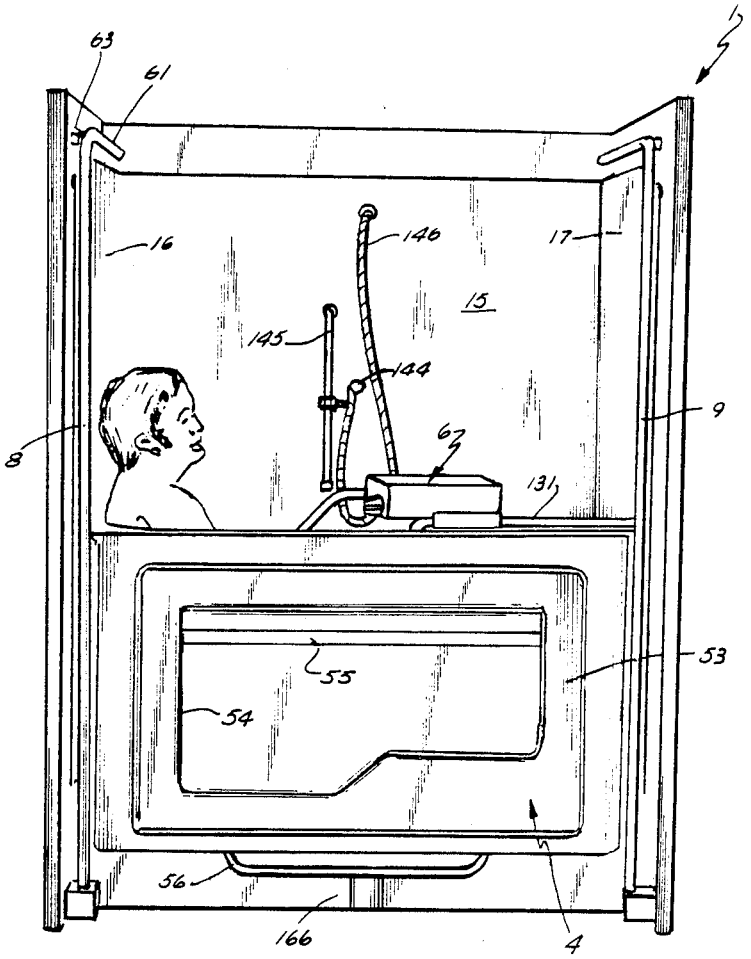
FIG. 18 is a front elevational view of the bathing unit, wherein the bather is shown seated within the bathtub, with the door fully closed.

In operation, bathing unit 1 is designed to be used as follows. With door 4 in the fully open position (FIG. 1), the bather positions himself facing the front of bathtub 2, adjacent seat 18. The bather then grasps the left-hand support rod 8 in his right hand, and turns around 180 degrees, with his back oriented toward bathtub seat 18. The bather then grasps the right-hand support post 131 for console 6 with his left hand, and lowers his buttocks onto the seat portion 19 of seat 18, as illustrated in FIG. 16. The bather then rotates his legs inwardly into footwell 21. With his right hand, the bather then grasps handle 56 on door 4, and pulls door 4 downwardly until snap-lock 168 is engaged. The bather then grasps handle 126 on adjustable control console 6, and pulls the same forwardly to a convenient location at which he can easily manipulate the various controls. The bather then manipulates door lock actuator 10, which fully closes and seals door 4, as shown in FIG. 18. The bather then adjusts the temperature of the water, and actuates the tub-fill and/or the shower head, as the bather so desires. For immersal bathing, drain valve 25 is closed by manipulating controller 115. When bathtub 2 is at least partially filled, the bather may then actuate the whirlpool, and adjust the level of aeration accordingly.

When the bather is finished, the water and whirlpool controllers 113–114 and 116–117 are shut off, and the drain valve controller 115 is shifted to the open position. As soon as the water has drained from bathtub 2, door lock 7 is deactivated by manipulating controller 10, control console 6 is pushed forwardly to the retracted, out of the way storage position, and the bather pulls upwardly on door 4. As soon as the snap-lock 168 has been released, door 4 will automatically raise to the fully open position under the spring tension of counterbalance 88. The bather may then exit bathtub 2 by using the combination support posts and grab bars 8 and 131.

Bathing unit 1 is particularly designed for home use, since door 4 and water controls 109 can be easily operated by the user himself from within the bathtub 2. The combination door guide and grab bar arrangement 5 not only provides for a smooth, easily operating door, which can be manually manipulated by even those of limited physical strength or dexterity, but it also assists in safely entering and exiting the bathtub. The adjustable control console 6 gives the bather easy access to all of the controls 109 for the various bathing functions when he is seated in bathtub 2. Yet, adjustable control console 6 can be moved out of the way into a retracted storage position to provide unhindered ingress and egress to bathtub 2. The power door lock 7 securely closes door 4 in a manner that forms a watertight seal, and does not require any significant degree of physical strength or dexterity to operate. The actuator for power door lock 7 is also positioned on adjustable control console 6, so that all of the bathtub functions can be readily controlled by the bather himself from within bathtub 2.

In the foregoing description, it will be readily appreciated by those skilled in the art that modifications may be made to the invention, without departing from the concepts disclosed herein. Such modifications are to be considered as included in the following claims, unless these claims by their language expressly state otherwise.

The embodiments of the invention in which an exclusive property or privilege is claimed are defined as follows:

1. A home bathing unit, comprising:

a bathtub having opposite sidewalls and end walls, with an access opening in one of said sidewalls for bather ingress and egress therethrough;

a seat located in said bathtub adjacent to one of said end walls;

a door shaped to selectively close said access opening;

means for vertically guiding said door between a fully open position wherein bather movement through said access opening is permitted, and a fully closed position wherein said door sealingly closes said access opening;

means for securely locking said door in the fully closed position;

a lock actuator operably connected with said locking means, and positioned to be manipulated by a bather disposed on the seat in said bathtub;

a handle located on said door at a position thereon from which a bather disposed on the seat in said bathtub can grasp said handle and manually translate said door between the fully open and fully closed positions;

a door controller, having means for retaining said door in said fully open position until moved therefrom by the bather, and means for adjusting the height of said door in the fully open position, so that said door is high enough to permit the bather to readily enter said bathing unit through said access opening, yet low enough to permit the bather, when disposed on the seat in said bathtub, to reach said handle and close said door, whereby the bather may enter and exit the bathing unit, and open, close and lock said door by himself from a seated position within said bathtub, without requiring an assistant.

2. A home bathing unit as set forth in claim 1, wherein:

said door controller further comprises a spring loaded counterbalance operably connected with said door, and resiliently retaining said door in the fully open position.

3. A home bathing unit as set forth in claim 2, wherein:

said door height adjustment means comprises means for adjusting spring tension in said counterbalance.

4. A home bathing unit as set forth in claim 3, wherein:

said door height adjustment means further comprises a stop connected with one of said door and said bathtub, and shaped to abuttingly engage the other of said door and said bathtub to positively locate said door in the fully open position.

5. A home bathing unit as set forth in claim 4, wherein said door guiding means comprises:

a combination door guide and grab bar arrangement, including a pair of upright support posts positioned adjacent opposite side edges of said door, and guides mounted on the opposite side edges of said door and telescopingly received over said support posts for sliding translation therealong, whereby said support posts both guide said door between the fully open and fully closed positions, and also provide vertical grab bars along the sides of said access opening to facilitate bather ingress and egress therethrough without interfering with the operation of said door.

6. A home bathing unit as set forth in claim 5, including:

an adjustable control console mounted on the end wall of said bathtub opposite said seat for sliding movement along a generally horizontal plane, and including a handle positioned to be grasped by a bather disposed on the seat in said bathtub, whereby the seated bather may himself vary the fore-to-aft position of said console with respect to said seat for ease of operation.

7. A home bathing unit as set forth in claim 6, wherein:

said lock actuator is mounted on said adjustable control console.

8. A home bathing unit as set forth in claim 7, including:

a bathtub fill spout attached to said adjustable control console, and translating therewith; and means for nonrigidly communicating said bathtub fill spout with a source of pressurized water.

9. A home bathing unit as set forth in claim 8, wherein said door locking means comprises:

a lock pin connected with said door and protruding outwardly from a lower edge of said door;

a latch arm connected with said bathtub, and shaped to matingly engage said lock pin when said door is in an initial closed position;

power means for mechanically moving said latch arm laterally into engagement with said lock pin;

power means for mechanically moving said latch arm longitudinally, and pulling said lock pin and said door downwardly until said door is in the fully closed position; and means for retaining said door in the fully closed position until released therefrom.

10. A home bathing unit as set forth in claim 9, wherein:

said power means includes a hydraulic ram actuated by water pressure.

11. A home bathing unit as set forth in claim 10, wherein:

said lock actuator comprises a valve which controls water pressure to said hydraulic ram.

12. A home bathing unit as set forth in claim 11, wherein:

said access opening is defined by a lip having an upwardly opening, wedge-shaped contour; and said door has a wedge-shaped sealing edge which conforms to the contour of said lip.

13. A home bathing unit as set forth in claim 12, including:

a compression seal positioned between the lip on said bathtub and the sealing edge of said door.

14. A home bathing unit as set forth in claim 13, including:

means for adjusting the effective length of said lock pin to vary compression force applied to said seal.

15. A home bathing unit as set forth in claim 14, wherein:

said bathtub_lip and said door sealing edge have an arcuate, front-elevational shape.

16. A home bathing unit as set forth in claim 15, wherein:

said bathtub lip and said door sealing edge have a generally semicircular, front-elevational shape to facilitate substantially uniform compression of said seal.

17. A home bathing unit as set forth in claim 16, wherein:

said seat is integrally formed with said bathtub, and comprises a seat portion disposed at an elevation substantially commensurate with conventional chair height, a back portion extending generally upwardly from said seat portion, and a foot portion disposed below and forward of said seat portion.

18. A home bathing unit as set forth in claim 17, wherein:

said seat, back and foot portions are integrally formed, and have an anatomical shape for comfortably supporting a seated bather.

19. A home bathing unit as set forth in claim 18, wherein:

said door support posts have a generally inverted L-shape in side elevation; and said guides are pivotal with respect to said door, whereby said door may assume an overhead storage position.

20. A home bathing unit as set forth in claim 1, wherein said door guiding means comprises:

a combination door guide and grab bar arrangement, including a pair of upright support posts positioned adjacent opposite side edges of said door, and guides mounted on the opposite side edges of said door and telescopingly received over said support posts for sliding translation therealong, whereby said support posts both guide said door between the fully open and fully closed positions, and also provide vertical grab bars along the sides of said access opening to facilitate bather ingress and egress therethrough without interfering with the operation of said door.

21. A home bathing unit as set forth in claim 20, wherein:

said door support posts have a generally inverted L-shape in side elevation; and said guides are pivotal with respect to said door, whereby said door may assume an overhead storage position.

22. A home bathing unit as set forth in claim 1, including:

an adjustable control console mounted on the end wall of said bathtub opposite said seat for sliding movement along a generally horizontal plane, and including a handle positioned to be grasped by a bather disposed on the seat in said bathtub, whereby a seated bather may himself vary the fore-to-aft position of said console with respect to said seat for ease of operation.

23. A home bathing unit as set forth in claim 1, wherein said door locking means comprises:

a lock pin connected with said door and protruding outwardly from a lower edge of said door;

a latch arm connected with said bathtub, and shaped to matingly engage said lock pin when said door is in an initial closed position;

power means for mechanically moving said latch arm laterally into engagement with said lock pin;

power means for mechanically moving said latch arm longitudinally, and pulling said lock pin and said door downwardly until said door is in the fully closed position; and means for retaining said door in the fully closed position until released therefrom.

24. A home bathing unit as set forth in claim 1, wherein:

said access opening is defined by a lip having an upwardly opening, wedge-shaped contour;

said door has a wedge-shaped sealing edge which conforms to the contour of said lip;

a compression seal is positioned between the lip on said bathtub and the sealing edge of said door; and said bathtub lip and said door sealing edge have a generally semicircular, front-elevational shape to facilitate substantially uniform compression of said seal.

25. In a bathing apparatus of the type having a bathtub with an access opening in one side thereof, and a vertically translating door selectively closing said access opening, the improvement of a combination door guide and grab bar arrangement comprising:

a pair of upright support posts positioned adjacent opposite side edges of said door, and disposed in a mutually parallel and generally vertical orientation;

guides mounted on the opposite side edges of said door, and being telescopingly received over said support posts for sliding translation therealong, whereby said support posts both guide said door between open and closed positions, and also provide vertical grab bars along the sides of said access opening to facilitate user ingress and egress, without interfering with the operation of said door.

26. A bathing apparatus as set forth in claim 25, wherein said guides comprise:

a first pair of sleeve-shaped guides, mounted in the side edges of said door adjacent an upper edge thereof;

a second pair of sleeve-shaped guides mounted in the side edges of said door adjacent a lower edge thereof, whereby both sides of said door are securely and evenly supported on said support posts for smooth, non-binding translation therealong.

27. A bathing apparatus as set forth in claim 26, wherein:

said door support posts have a generally inverted L-shape in side elevation; and at least said first pair of guides are pivotal with respect to said door, whereby said door may assume an overhead storage position.

28. A bathing apparatus as set forth in claim 27, wherein:

said second pair of guides are pivotal with respect to said door, whereby said door may assume a fully overhead storage position.

29. A bathing apparatus as set forth in claim 28, wherein:

at least one of said support posts includes a support bracket extending outwardly therefrom to attach said support post to a stationary surface; and at least one of said first and second pairs of guides includes a longitudinally extending slot through which said rod support bracket passes as said door is translated between the open and closed positions.

30. A bathing apparatus as set forth in claim 29, wherein:

said support posts have a cylindrical shape; and said guides have a generally cylindrical shape, with antifriction inserts therein which glide over the exterior surfaces of said support posts.

31. A bathing apparatus as set forth in claim 30, wherein:

said guides each include a laterally extending mounting pin; and said door includes antifriction bushings mounted in the side edges thereof in which an associated mounting pin of said guides is closely received to rotatably mount said guides in said door.

32. A bathing apparatus as set forth in claim 31, including:

coil springs positioned over the mounting pins of said guides, and resiliently urging the side edges of said door inwardly, whereby said door floats laterally between said guides for non-binding translation over said support posts.

33. A bathing apparatus as set forth in claim 32, wherein:

said access opening is defined by a lip having an upwardly opening, wedge-shaped contour;

said door has a wedge-shaped sealing edge which conforms to the contour of said lip; and a compression seal is disposed between the lip of said bathtub and the sealing edge of said door, whereby said bathtub lip and said door sealing edge self-align as said door floats laterally between said guides.

34. A bathing apparatus as set forth in claim 25, wherein:

said support posts include at least one support bracket extending outwardly therefrom to attach said support posts to a stationary surface; and at least one of said first and second pairs of guides includes longitudinally extending slots through which said rod support brackets pass as said door is translated between the open and closed positions.

35. In a bathing apparatus of the type having a bathtub with at least one water dispenser, a seat area at one end of said bathtub, and a controller for said water dispenser at the other end of said bathtub, the improvement of an adjustable console comprising:

a cabinet having a chassis, and a front plate facing the one end of said bathtub;

means for connecting said controller to said chassis, with a variable actuator portion of said controller extending through said front plate and accessible to a user disposed at the seat area of said bathtub;

a console support connected with said bathtub, and having means for slidingly mounting said cabinet thereon at the other end of said bathtub for selective movement along a generally horizontal plane; and means for non-rigidly communicating said controller with a source of pressurized water, whereby said console is bodily translated along said support to adjust the fore-to-aft position of said console with respect to the seat area of said bathtub for a particular user, such that variously sized users can readily grasp and manipulate the actuator portion of said controller.

36. A bathing apparatus as set forth in claim 35, including:

a handle connected with said adjustable console, and positioned to be grasped by a user disposed in the seat area of said bathtub, whereby the user may himself adjust the position of said console, without requiring an assistant.

37. A bathing apparatus as set forth in claim 36, wherein said bathtub includes:

opposite sidewalls, and front and rear end walls, with an access opening in one of said sidewalls for user ingress and egress therethrough; and a door selectively closing said access opening.

38. A bathing apparatus as set forth in claim 37, wherein:

said console support comprises a combination support and grab bar arrangement, including:

a first post having a straight, horizontally oriented upper leg with one end thereof mounted in the front end wall of said bathtub adjacent said access opening, and the other end formed into a handle;

a guide attached to said cabinet and telescopingly received over the upper leg of said first post for slidingly supporting said console for translation therealong.

39. A bathing apparatus as set forth in claim 38, wherein said combination support and grab bar arrangement further comprises:

a second post having a straight, horizontally oriented upper leg with one end thereof mounted in the front end wall of said bathtub adjacent the other sidewall of said bathtub, and the other end formed into a handle; and a guide attached to said cabinet and telescopingly received over the upper leg of said second post and slidingly supporting said console for translation therealong.

40. A bathing apparatus as set forth in claim 39, wherein:

said first post has a straight downwardly inclined lower leg with one end thereof mounted in the front end wall of said bathtub adjacent said access opening, and below the upper leg of said first post; and said first post has an arcuate intermediate portion interconnecting the other ends of the upper and lower legs of said first post, and forming a grab handle.

41. A bathing apparatus as set forth in claim 40, wherein:

said second post has a straight, downwardly inclined lower leg, with one end thereof mounted in the other sidewall of said bathtub adjacent an armrest portion thereof, and the other end connected with the other end of the upper leg of said second post.

42. A bathing apparatus as set forth in claim 41, wherein:

said first and second posts are positioned on opposite sides of said cabinet for secure support.

43. A bathing apparatus as set forth in claim 42, including:

a bathtub fill spout connected with said cabinet and translating therewith; and means for non-rigidly communicating said bathtub fill spout with a source of pressurized water.

44. A bathing apparatus as set forth in claim 43, wherein:

said water dispenser comprises a shower head with a flexible supply hose.

45. A bathing apparatus as set forth in claim 44 including:

means for controlling water flow through said bathtub fill spout, being mounted in said cabinet and operable from the front plate thereof.

46. A bathing apparatus as set forth in claim 45, including:

means for controlling water flow through said shower head, being mounted in said cabinet, and operable from the front plate thereof.

47. A bathing apparatus as set forth in claim 46, including:

means for controlling the temperature of water flowing through said bathtub fill spout and said shower head, being mounted in said cabinet, and operable from the front plate thereof.

48. A bathing apparatus as set forth in claim 47, including:

a lock for selectively retaining said door in the closed position; and means for controlling said door lock, being mounted in said cabinet, and operable from the front plate thereof.

49. A bathing apparatus as set forth in claim 48, including:

a drain mounted in a floor portion of said bathtub, and including a shut-off valve; and means for controlling said drain shut-off valve, being mounted in said cabinet, and operable from the front plate thereof.

50. A bathing apparatus as set forth in claim 49, including:

means for swirling and aerating water in said bathtub; and means for controlling said water swirling and aerating means, with an actuator portion thereof being mounted in said cabinet, and operable from the front plate thereof.

51. A bathing apparatus as set forth in claim 35, including:

a bathtub fill spout connected with said cabinet and translating therewith; and means for non-rigidly communicating said bathtub fill spout with a source of pressurized water.

52. A bathing apparatus as set forth in claim 35, wherein:

said water dispenser comprises a shower head with a flexible supply hose.

53. In a bathing apparatus of the type having a bathtub with a seat area at one end thereof, an access opening in one side of said bathtub, a vertically translating door selectively closing the opening, and a lock for retaining said door in a fully closed and sealed position, the improvement of an adjustable console, comprising:

a cabinet having a chassis, and a front plate facing the one end of said bathtub;

a motor for shifting said door lock between locked and unlocked positions, and including a remote controller therefor;

means for connecting said lock controller with said chassis, with an actuator portion of said lock controller extending through said front plate, and accessible to a user disposed in the seat area of said bathtub;

a console support connected with said bathtub, and having means for slidingly mounting said cabinet thereon at the other end of said bathtub for selective movement along a generally horizontal plane; and means for non-rigidly connecting said lock controller with said motor, whereby said console is bodily translated along said support to adjust the fore-to-aft position of said console with respect to the seat area of said bathtub for a particular user, such that variously sized users can readily grasp and manipulate the actuator portion of said lock controller.

54. A bathing apparatus as set forth in claim 53, including:

a handle connected with said adjustable console, and positioned to be grasped by a user disposed in the seat area of said bathtub, whereby the user may himself adjust the position of said console, without requiring an assistant.

55. In a bathing apparatus of the type having a bathtub with an access opening defined by a lip having an upwardly opening, wedge-shaped contour, and a vertically translating door with a wedge-shaped sealing edge which conforms to the contour of said lip, and a compression seal positioned between said lip and said sealing edge, an improved locking arrangement for said door, comprising:

a lock pin connected with said door and protruding outwardly from a lower edge of said door;

a latch arm connected with said bathtub, and shaped to matingly engage said lock pin when said door is in an initial closed position;

power means for mechanically moving said latch arm laterally into engagement with said lock pin;

power means for mechanically moving said latch arm longitudinally, and pulling said lock pin and said door downwardly until said compression seal is seated between the lip of said bathtub and the sealing edge of said door to form a watertight seal therebetween, and thereby define a fully closed door position; and means for retaining said door in the fully closed position until released therefrom.

56. A bathing apparatus as set forth in claim 55, wherein:

said power means for moving said latch arm laterally and longitudinally includes a hydraulic ram actuated by water pressure.

57. A bathing apparatus as set forth in claim 56, wherein:

said lock pin is cylindrically shaped, and includes an elongate, annular slot adjacent the free end thereof which defines shank and head portions of said lock pin; and said latch arm includes a fork with two prongs at the free end thereof shaped for reception over said pin shank and engagement with the head portion of said lock pin.

58. A bathing apparatus as set forth in claim 57, including:

a snap lock selectively retaining said door in said initial closed position in which said fork is laterally aligned with the mating slot in said lock pin for engagement therewith.

59. A bathing apparatus as set forth in claim 58, including:

means for adjusting the effective length of said lock pin to vary pressure on said compresion seal.

60. A bathing apparatus as set forth in claim 59, wherein said power means for moving said latch arm laterally and longitudinally further comprises:

a cam-slide linkage connected with a reciprocating end of said hydraulic ram.

61. A bathing apparatus as set forth in claim 60, wherein said cam-slide linkage comprises:

a bracket fixedly connected with said bathtub, and including two, spaced-apart, parallel plates between which a body portion of said latch arm is closely and slidingly received;

a pair of aligned slots in said bracket plates, having a laterally extending, downwardly inclined upper leg, and a vertically extending lower leg communicating therewith;

a pin mounted in the body portion of said latch arm, having opposite ends thereof extending through said aligned slots; and a link pivotally mounted between said bracket plates at a medial portion of said link; a first end of said link being pivotally connected with the reciprocating end of said hydraulic jack, and a second end of said link being pivotally connected with a lower end of said latch arm, whereby extension of said hydraulic jack shifts said latch arm along the path of said aligned slots, laterally outwardly to engage said fork in the annular slot in said lock pin, thence vertically downwardly to pull said door into the fully closed position.

62. A bathing apparatus as set forth in claim 61, wherein said cam-slide linkage further comprises:

a return spring connected with the first end of said link to automatically return said latch arm to a raised, unlocked position.

63. A bathing apparatus as set forth in claim 62, including:

a valve controlling the supply of pressurized water to said hydraulic ram, and defining said door retaining means.

64. A bathing apparatus as set forth in claim 55, wherein:

said lock pin is cylindrically shaped, and includes an elongate, annular slot adjacent the free end thereof which defines shank and head portions of said lock pin; and said latch arm includes a fork with two prongs at the free end thereof shaped for reception over said pin shank and engagement with the head portion of said lock pin.

65. A bathing apparatus as set forth in claim 55, including:

a snap lock selectively retaining said door in said initial closed position, in which said fork is laterally aligned with the mating annular slot in said lock pin for engagement therewith.

66. A bathing apparatus as set forth in claim 55, including:

means for adjusting the effective length of said lock pin to vary pressure on said compression seal.

67. A bathing apparatus as set forth in claim 55, wherein said power means for moving said latch arm laterally and longitudinally comprises:

a linear motor; and a cam-slide linkage connected between said latch arm and a reciprocating end of said linear motor.

* * * * *